US007068959B2

(12) United States Patent
Allen et al.

(10) Patent No.: US 7,068,959 B2
(45) Date of Patent: Jun. 27, 2006

(54) FUSER OIL CONTAMINATION PREVENTION AND CLEAN-UP METHOD

(75) Inventors: Richard G. Allen, Rochester, NY (US); Thomas N. Tombs, Rochester, NY (US); David M. Rakov, Rochester, NY (US)

(73) Assignee: Eastman Kodak Company, Rochester, NY (US)

( * ) Notice: Subject to any disclaimer, the term of this patent is extended or adjusted under 35 U.S.C. 154(b) by 88 days.

(21) Appl. No.: 10/945,489

(22) Filed: Sep. 20, 2004

(65) Prior Publication Data

US 2006/0062590 A1 Mar. 23, 2006

(51) Int. Cl.
*G03G 21/00* (2006.01)

(52) U.S. Cl. ..... 399/98; 399/326; 399/343; 399/303

(58) Field of Classification Search ..... 15/256.51, 15/256.52; 399/98, 101, 297, 302, 303, 308, 399/309, 324, 326, 343, 350, 352, 351
See application file for complete search history.

(56) References Cited

U.S. PATENT DOCUMENTS 6,222,606 B1 * 4/2001 Fuchiwaki et al. ..... 355/24
6,507,724 B1 * 1/2003 Tamura et al. ..... 399/297
6,954,603 B1 * 10/2005 Brown et al. ..... 399/101

* cited by examiner

*Primary Examiner*—Hoang Ngo
(74) *Attorney, Agent, or Firm*—Lawrence P. Kessler

(57) ABSTRACT

Preventing the imaging forming process of an electrostatographic reproduction apparatus having a plurality of imaging modules in tandem relative to a receiver transport belt moveable along a transport path from becoming contaminated with fuser release oil. A substantially uniform layer of the pigmented marking particles from the development subsystem of the image forming process is deposited onto the photoconductive member of the image forming process during any non-imaging cycles of the process, including cycle down, non-imaging skip frames, or recovery from a receiver jam. The substantially uniform layer of pigmented marking particles acts as a barrier to block fuser release oil from the photoconductive member and as a vehicle to carry away contaminating fuser release oil.

12 Claims, 3 Drawing Sheets

FUSER OIL CONTAMINATION PREVENTION AND CLEAN-UP METHOD

FIELD OF THE INVENTION

This invention relates to prevention of fuser release oil contamination in the image forming process of an electrostatographic reproduction apparatus and, if such contamination has already occurred, to clean-up of the fuser release oil contamination from the electrostatographic reproduction apparatus subsystems.

BACKGROUND OF THE INVENTION

In typical commercial reproduction apparatus (electrographic copier/duplicators, printers, or the like), a latent image charge pattern is formed on a uniformly charged charge-retentive or photoconductive member having dielectric characteristics. Pigmented marking particles are attracted to the latent image charge pattern to develop such image on the photoconductive member. A receiver member, such as a sheet of paper, transparency, or other medium, is then brought into contact with the photoconductive member, and an electric field applied to transfer the marking particle developed image to the receiver member from the photoconductive member. The electric field to transfer the marking particle developed image to the receiver member from the photoconductive member is typically applied by spraying the backside of the receiver member with electrically charged ions from a corona charging device or, alternatively, by contacting the backside of the receiver member with an electrically biased transfer member. The electrically biased transfer member may be an electrically biased roller in contact with the receiver member or an electrically biased roller in contact with a transport member, such as a flexible belt, on which the receiver member is carried. Another alternative is to first transfer the marking particle developed image directly to an electrically biased intermediate transfer member in the form of a roller or belt and then from the intermediate transfer member to the receiver member.

After transfer to the receiver member, by any of the above alternatives, the receiver member bearing the transferred image is transported to a fixing device where the image is fixed (fused) to the receiver member by heat and/or pressure to form a permanent reproduction thereon. Typically the fixing device has a nip formed between a pair of rollers, one of which, hereafter referred to as the fuser roller, is heated to a temperature high enough to fuse the marking particle image to the receiver member as the receiver member is passed through the nip with the side bearing the marking particle image in contact with the fuser roller. In order to prevent particles of the marking particle image, or the receiver member bearing the fused marking particle image, from sticking to the fuser roller, release oil is typically applied to the fuser roller. After exiting the fuser roller nip a quantity of the release oil typically remains on the receiver member, especially on the side that contacted the fuser roller.

To print an image on both sides of the receiver member, hereafter referred to as duplex printing, a fused marking particle image is formed on side one of the receiver member by the above process, whereafter the receiver member is returned to the process via a duplex return path. In this duplex return path, the receiver member is turned over so as to have a second marking particle developed image transferred and fused to side two of the receiver member. In duplex printing, when transferring the marking particle developed image to side two of the receiver member, if the electric field for transfer is applied by an electrically biased transfer member as described above, some of the fuser release oil from side one of the receiver member, which is now in contact with the biased transfer member, transfers to the surface of the biased roller. During a long duplex printing run a relatively large amount of fuser release oil can thereby accumulate on the biased transfer member. During times such as cycle-down, non-imaging skip frames, and recovery from receiver jams, the biased transfer member is in direct contact with the photoconductive member. During these times some of the fuser release oil accumulated on the biased transfer member during duplex printing transfers to the photoconductive member and can cause image quality defects during subsequent printing. The intermediate transfer member alternative mentioned above also provides a path for fuser release oil to contaminate the photoconductive member. In this case, during duplex printing, fuser release oil from side one of the receiver members accumulates on the electrically biased transfer member that transfers the marking particle developed image from the intermediate transfer member to the receiver member. Then during times such as cycle-down, non-imaging skip frames, and recovery from receiver jams the biased transfer member is in direct contact with the intermediate transfer member. The oil then transfers to the intermediate transfer member and from the intermediate transfer member to the photoconductive member.

Co-pending U.S. patent application Ser. No. 10/667,797, discloses a method for preventing or, if necessary, cleaning up fuser oil contamination in electrostatographic reproduction apparatus as described above. Co-pending U.S. patent application Ser. No. 10/667,797 teaches the use of a uniform layer of the above described marking particles on the surface of the photoconductive member, or intermediate transfer member if used, as a barrier to prevent fuser release oil from transferring from the biased transfer member to the photoconductive member, or intermediate transfer member if used. Specifically, the method disclosed in patent application Ser. No. 10/667,797 is to deposit, from the development subsystem, onto the surface of the photoconductive member, or intermediate transfer member if used, a uniform layer of the marking particles, during any of the non-imaging periods when the photoconductive member, or intermediate transfer member if used, is in operative contact with the biased transfer member, during or after a duplex printing run. The uniform layer of marking particles is transferred directly to the biased transfer member and, in the process, acts as a shield preventing transfer of fuser release oil to the photoconductive member, or intermediate transfer member if used. The fuser release oil from the biased transfer member transfers to the marking particles and is carried away with the marking particles when they are removed from the biased transfer member by a cleaning device such as scraper blade, rotating fiber brush, or any other means capable of removing them.

During the normal image printing process in electrostatographic reproduction apparatus of the type described above, marking particles do not routinely find their way to the biased transfer element, and, as a result, the collection reservoir of the transfer element cleaner is typically sized relatively small. In reproduction apparatus with such relatively small sized transfer element cleaner reservoirs, if the method of fuser release oil prevention or clean-up described above is used, the transfer element cleaner reservoir will fill up quickly and thus require frequent attention from the operator.

SUMMARY OF THE INVENTION

In light of the above, the object of the present invention is to provide a method of fuser oil contamination prevention and clean up that avoids use of the transfer element cleaner in an electrostatographic reproduction apparatus. In the preferred embodiment the fuser oil contamination prevention and clean-up methods of the present invention are used in an electrostatographic reproduction apparatus having a plurality of imaging modules in tandem along a receiver transport belt. A uniform layer of marking particles is deposited onto the photoconductive member of the first imaging module, transferred directly to the receiver transport belt, and then transferred from the receiver transport belt to the photoconductive member of the last imaging module. The uniform layer of marking particles is removed from the last imaging module photoconductive member by the photoconductive member cleaner. If an intermediate transfer element is used, a uniform layer of marking particles is deposited onto the intermediate transfer element of the first imaging module, transferred directly to the receiver transport belt, and then transferred from the receiver transport belt to the intermediate transfer element of the last imaging module. The uniform layer of marking particles is removed from the last imaging module intermediate transfer element by the intermediate transfer element cleaner.

BRIEF DESCRIPTION OF THE DRAWINGS

In the detailed description of the preferred embodiment of the invention presented below, reference is made to the accompanying drawings, in which.

DETAILED DESCRIPTION OF THE INVENTION

Electrostatographic reproduction apparatus generally are well known. Therefore the present description will be directed in particular to elements forming part of, or cooperating more directly with the present invention. There exist many different embodiments of the electrographic image forming process used in such reproduction apparatus. This description will use three examples to teach the present invention, but it must be understood that the present invention is not limited to these examples, but rather could be practiced in any embodiment with the same image forming steps.

Figure 1:
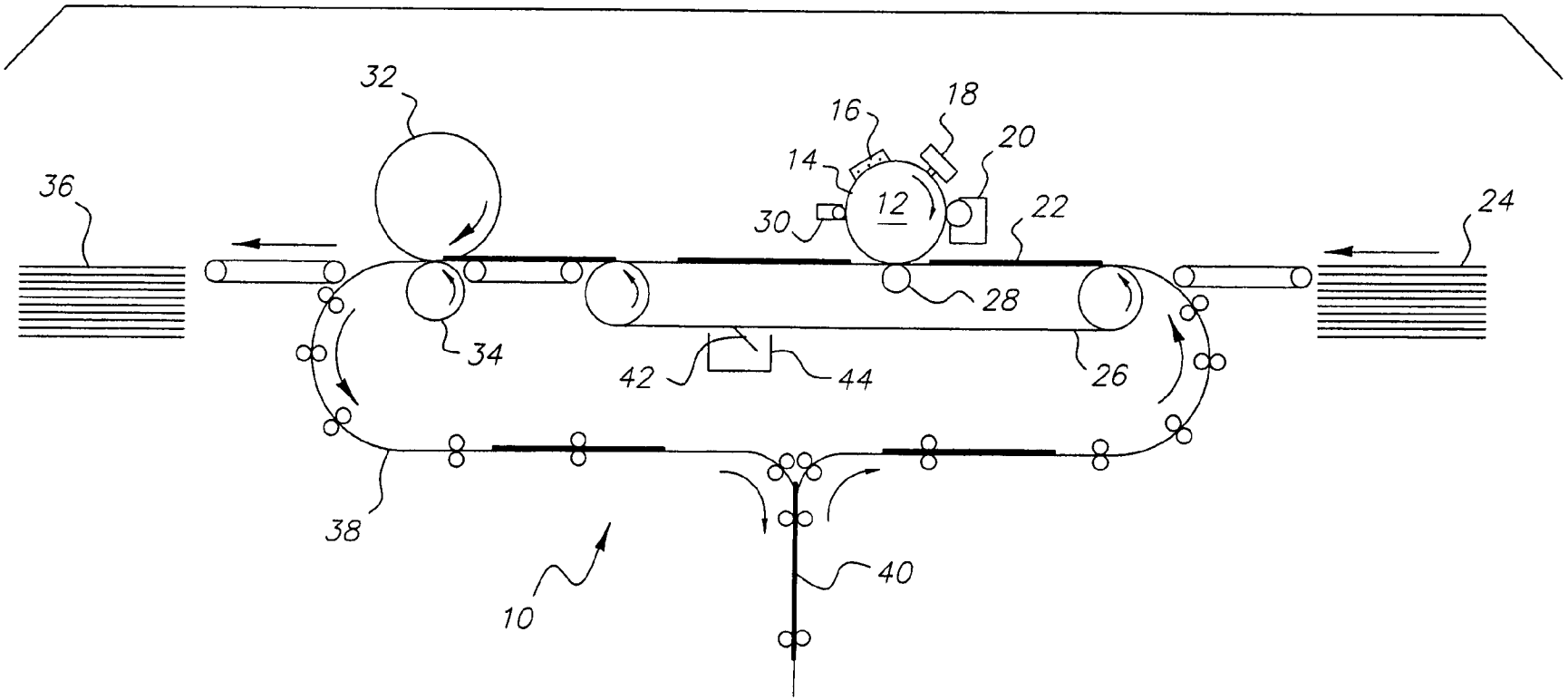
FIG. 1 is a schematic illustration of a side view of an electrographic reproduction apparatus in which the method of the present invention may be used.

With reference to the electrographic reproduction apparatus 10 as shown in FIG. 1, an imaging drum 12 is provided on which is coated a photoconductive member 14. The imaging drum 12 is selectively rotated, by any well-known drive mechanism (not shown), in the direction indicated by the arrow, to advance the photoconductive member 14 past a series of subsystems of the electrographic reproduction apparatus. A primary charging device 16 is provided to deposit a uniform electrostatic charge onto the photoconductive member 14. The uniform charge on the photoconductive member 14 is subsequently selectively dissipated by, for example, a digitally addressed exposure subsystem 18, such as a Light Emitting Diode (LED) array or a scanned laser, to form an electrostatic latent image of a document to be reproduced. The electrostatic latent image is then rendered visible by development subsystem 20, which deposits charged, pigmented marking particles onto the photoconductive member 14 in accordance with the electrostatic charge pattern of the latent image. The developed marking particle image is then transferred to a receiver member 22 that has been fed from supply 24 onto the transport belt 26. The electric field to transfer the marking particle image from the photoconductive member 14 to the receiver member 22 is provided by electrically biased roller 28. Cleaner 30 cleans any marking particles that are not transferred from the photoconductive member 14 to the receiver member 22. The receiver member 22 bearing the marking particle image is then transported through the nip formed between fuser roller 32 and pressure roller 34 wherein the marking particle image is fused by heat and pressure to the receiver member 22.

The fuser roller 32 is heated to a temperature high enough to fuse the marking particle image to the receiver member 22 as the receiver member 22 is passed through the nip with the side bearing the marking particle image in contact with the fuser roller 32. After exiting the fuser nip, if the print job calls for an image on just side one of the receiver member 22, the receiver member 22 is transported to output stack 36. If the print job calls also for an image on side two (the reverse side) of the receiver member 22, hereafter referred to as duplex printing, the receiver member 22 is not transported to the output stack 36, but rather is diverted to return path 38. In return path 38, the receiver member 22 is turned over in turnover device 40 and then returned to transport belt 26 whereupon a second marking particle image is transferred to side two of receiver member 22. The receiver member 22 bearing the marking particle image on side two is then transported through the nip formed between fuser roller 32 and pressure roller 34 wherein the marking particle image on side two of the receiver member 22 is fused by heat and pressure to side two of the receiver member 22. After exiting the fuser nip the receiver member, with images on both sides, is transported to output stack 36.

Figure 2:
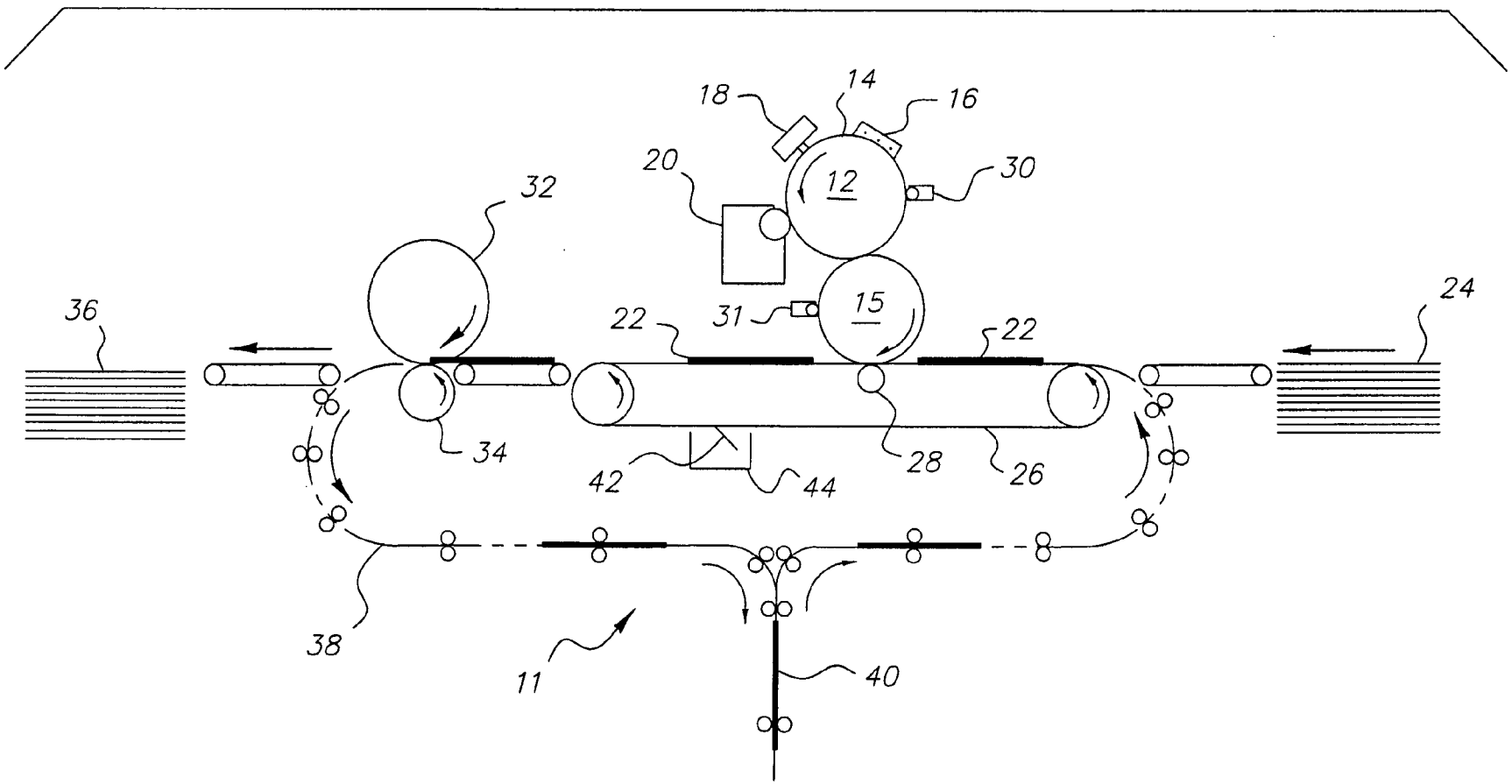
FIG. 2 is a schematic illustration of a side view of an alternate electrographic reproduction apparatus in which the method of the present invention may be used.

FIG. 2 illustrates a variation of the electrographic reproduction apparatus in FIG. 1. In the variation illustrated in FIG. 2 the marking particle image formed on the photoconductor element is first transferred to an intermediate transfer element and then from the intermediate transfer element to the receiver element. All elements that are common to the two electrographic reproduction apparatus illustrated in FIG. 1 and FIG. 2 employ the same reference numerals. With reference to the electrographic reproduction apparatus 11 as shown in FIG. 2, an imaging drum 12 is provided on which is coated a photoconductive member 14. The imaging drum 12 is selectively rotated, by any well-known drive mechanism (not shown), in the direction indicated by the arrow, to advance the photoconductive member 14 past a series of subsystems of the electrographic reproduction apparatus. A primary charging device 16 is provided to deposit a uniform electrostatic charge onto the photoconductive member 14. The uniform charge on the photoconductive member 14 is subsequently selectively dissipated by, for example, a digitally addressed exposure subsystem 18, such as a Light Emitting Diode (LED) array or a scanned laser, to form an electrostatic latent image of a document to be reproduced.

The electrostatic latent image is then rendered visible by development subsystem 20, which deposits charged, pigmented marking particles onto the photoconductive member 14 in accordance with the electrostatic charge pattern of the latent image. The developed marking particle image is then transferred from photoconductive member 14 to intermediate transfer member 15. The electric field to transfer the marking particle image from photoconductive member 14 to intermediate transfer member 15 is provided by an appropriate bias voltage applied to intermediate transfer member 15. Cleaner 30 cleans any marking particles that are not transferred from the photoconductive member 14 to the intermediate transfer member 15. The marking particle image is then transferred from intermediate transfer member 15 to a receiver member 22 that has been fed from supply 24 onto the transport belt 26. The electric field to transfer the marking particle image from the intermediate transfer member 15 to the receiver member 22 is provided by electrically biased roller 28. Cleaner 31 cleans any marking particles that are not transferred from intermediate transfer member 15 to the receiver member 22. The receiver member 22 bearing the marking particle image is then transported through the nip formed between fuser roller 32 and pressure roller 34 wherein the marking particle image is fused by heat and pressure to the receiver member 22.

The fuser roller 32 is heated to a temperature high enough to fuse the marking particle image to the receiver member 22 as the receiver member 22 is passed through the nip with the side bearing the marking particle image in contact with the fuser roller 32. After exiting the fuser nip, if the print job calls for an image on just side one of the receiver member 22, the receiver member is transported to output stack 36. If the print job calls also for an image on side two of the receiver member 22, hereafter referred to as duplex printing, the receiver member 22 is not transported to the output stack 36, but rather is diverted to return path 38. In return path 38 the receiver member 22 is turned over in turnover device 40 and returned to transport belt 26 whereupon a second marking particle image is transferred to side two of receiver member 22. The receiver member 22 bearing the marking particle image on side two is then transported through the nip formed between fuser roller 32 and pressure roller 34 wherein the marking particle image on side two of the receiver member 22 is fused by heat and pressure to side two of the receiver member 22. After exiting the fuser nip the receiver member, with images on both sides, is transported to output stack 36.

Figure 3:
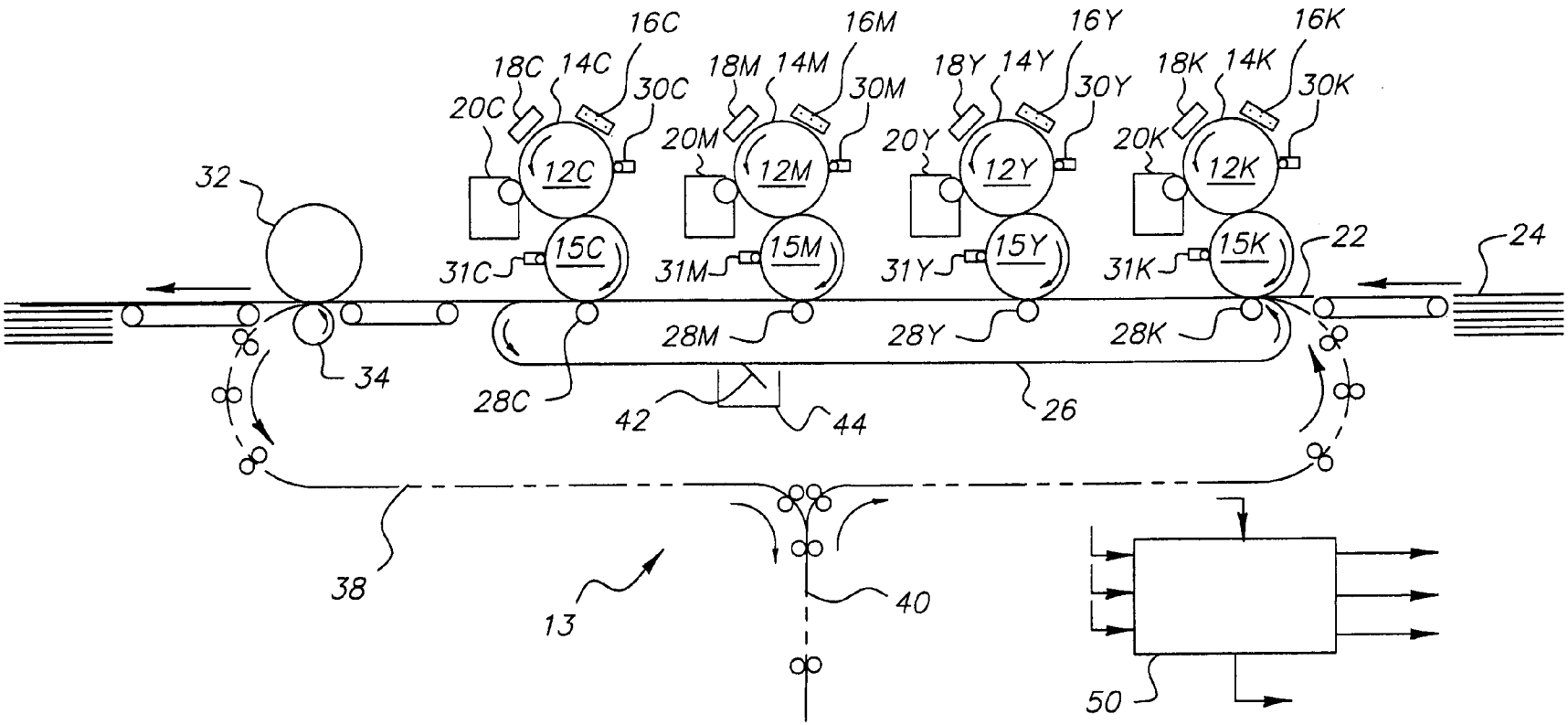
FIG. 3 is a schematic illustration of a side view of an electrographic reproduction apparatus with four imaging modules in which the method of the present invention may be used.

In the electrographic reproduction apparatus 10 and 11 illustrated in FIGS. 1 and 2 respectively, and described above, the combination of elements including the imaging drum 12 on which is coated the photoconductive member 14, the primary charging device 16, the exposure subsystem 18, the development subsystem 20, the electrically biased roller 28, the cleaner 30, (and the intermediate transfer element 15 with cleaner 31 in apparatus 11) will henceforth be referred to as the imaging module. Either electrographic reproduction apparatus, 10 depicted in FIG. 1 or 11 in FIG. 2, could include a plurality of imaging modules in sequence along the length of the transport belt 26 for the purpose of creating and transferring different respective colored marking particle images to the receiver element 22 in superimposed register. FIG. 3 illustrates, for example, a 4-color electrographic reproduction apparatus, generally designated by numeral 13 and corresponding to apparatus 11 in FIG. 2, with imaging modules respectively containing cyan (C), magenta (M), yellow (Y), and black (K) marking particles (of course, other members of modules are suitable for use with this invention). In FIG. 3 individual process elements in the imaging modules corresponding to the same elements in FIG. 2 are designated with the same numeral as in FIG. 2 but with a C, M, Y, or K.

In all three electrographic reproduction apparatus, 10 in FIG. 1, 11 in FIG. 2, and 13 in FIG. 3, release oil is applied to the fuser roller 32 in order to prevent the receiver member 22, with the fused marking particle image, from sticking to fuser roller 32 as it exits the nip between fuser roller 32 and pressure roller 34. After exiting the nip between fuser roller 32 and pressure roller 34, a quantity of the release oil typically remains on the receiver member 22 on the side that contacted fuser roller 32. During duplex printing, when transferring the marking particle image to side two of the receiver member 22, some of the fuser release oil remaining on side one, from fusing of the side one marking particle image, transfers to the transport belt 26 which is in contact with side one of the receiver member 22. During a long duplex printing run, a relatively large amount of fuser release oil can thereby accumulate on the transport belt 26.

Three opportunities, which will be describe below, can occur in which either photoconductor member 14 in apparatus 10, intermediate transfer element 15 in apparatus 11, or intermediate transfer elements 15C, M, Y, K in apparatus 13, will come into direct contact with transport belt 26 either during or after a duplex printing run. If that occurs and a significant amount of fuser release oil had accumulated on receiver transport belt 26, as described above, the film of fuser release oil on transport belt 26 will split and some will transfer to the intermediate transfer element in apparatus 11 or 13, or to the photoconductor element in apparatus 10. In apparatus 11 or 13 the release oil film thus formed on the intermediate transfer elements will then split and some will transfer to the photoconductor element. A significant accumulation of fuser release oil on the photoconductor member 14 in either apparatus 10, 11, or 13 can cause a variety of unacceptable image quality defects.

The opportunities for either photoconductor member 14 in apparatus 10 or the intermediate transfer elements in apparatus 11 or 13 to make direct contact with transport belt 26, during or following duplex printing runs, are during non-imaging skip frames, during cycle-down at the end of a duplex print run, and during recovery from a receiver element jam. Non-imaging skip frames are created by not feeding any receiver members from supply 24 and inhibiting the digitally addressed exposure subsystem 18, such that no pigmented marking particles are developed in the skip frames by development subsystem 20. One situation requiring non-imaging skip frames is during the production of multiple page, collated documents that are being duplex printed and the number of pages in the document is not equal to an integral of the number of pages it takes to fill the return path 38. Another situation requiring non-imaging skip frames is if sequential receiver members, fed from different supplies, require different fuser set points, and additional time is needed to change the fuser set points.

The present invention is directed to multi-module electrographic apparatus of the type illustrated in FIG. 3. A logic and control system is provided for the reproduction apparatus. The logic and control system 50 is, for example, microprocessor based, receiving appropriate signals from sensors associated with various elements of the reproduction apparatus. A suitable program for the logic and control system 50, well known in the art, enables the system 50 to control the image printing process previously described, including creation of non-imaging skip frames when required, the cycle down sequence, and the recovery from jams of receiver elements. The logic and control system 50 will determine/detect when frames on transport belt 26 containing fuser release oil will come into direct contact with intermediate transfer member 15K in the first imaging module. The logic and control system then adjusts the operating parameters of the first imaging module so that a uniform layer of marking particles is deposited by development subsystem 20K onto photoconductive member 14K, is transferred to intermediate transfer member 15K, and then transferred to those direct contact frames of transport belt 26. For this purpose the imaging module operating parameters are set to a predetermined level so that the uniform layer of marking particles is at least a monolayer of the marking particles. The uniform layer of marking particles acts as a barrier to prevent transfer of fuser release oil from transport belt 26 to intermediate transfer member 15K. The logic and control system 50 adjusts the operating parameters of the second and third imaging modules so that the uniform layer of marking particles remains on transport belt 26 as the uniform layer of marking particles is transported through the nips at intermediate transfer elements 15Y and 15M, thus preventing any transfer of fuser release oil from transport belt 26 to intermediate transfer elements 15Y and 15M. The logic and control system 50 adjusts the operating parameters of the fourth imaging module so that the uniform layer of marking particles is transferred from transport belt 26 to intermediate transfer member 15C. The fuser release oil from the transport belt 26 adheres to the marking particles and is removed from transport belt 26 along with the marking particles as they are transferred to intermediate member 15C. The uniform layer of marking particles with fuser release oil is then removed from intermediate member 15C by cleaner 31C.

Of course, in an alternate embodiment, the uniform layer of marking particles could have remained on transport belt 26 without being transferred to intermediate transfer member 15C. Marking particle removal from transport belt 26 then would be effected by cleaner blade 42. This alternate embodiment of the method of the present invention would only be advantageous if reservoir 44 were sized to accommodate a relatively large quantity of marking particles so as to not require frequent attention by the operator.

As described above, the transport belt 26 only accumulates fuser release oil during duplex printing when it comes into contact with the first side of receiver members during the transfer of a developed marking particle image to the second side. Therefore, the method of the present invention may be activated only for non-imaging skip frames, cycle down, and jam recovery during duplex printing runs. In addition it has been determined that a minimum duplex printing run length is required before enough fuser release oil accumulates on the transport belt 26 to cause image quality defects. Therefore, the method of the present invention may be activated only for non-imaging skip frames, cycle down, and jam recovery during duplex printing runs longer than this predetermined length.

The overall object of the present invention as described above is to prevent fuser oil contamination of photoconductor members 14C, M, Y, and K. However, if an event should occur that is not anticipated by the logic and control system 50, during which the photoconductor members 14C, M, Y, and K are inadvertently contaminated with fuser release oil, another embodiment of the present invention provides a fuser release oil clean-up mode. The clean-up mode is initiated, for example, automatically or by the reproduction apparatus operator if observed print quality defects are believed to be due to fuser release oil contamination. In the clean-up mode the operating parameters of all four imaging modules are adjusted so that a uniform layer of marking particles is deposited continuously onto photoconductive members 14C, M, Y, and K for a predetermined number of non-imaging cycles during which no receiver members are fed from supply 24. The contaminating fuser release oil on photoconductive members 14M, Y, and adheres to the marking particles and is carried away with the marking particles as the marking particles are transferred, first to intermediate transfer members 15M, Y, and K respectively, and then from intermediate transfer members 15M, Y, and K to transport web 26. In the fourth imaging module the marking particles from photoconductor member 14C are transferred to intermediate transfer member 15C, but not to transport belt 26, and are removed at cleaner 31C. The marking particles transferred to transport belt 26 from intermediate elements 15M, Y, and K are transferred from transport belt 26 to intermediate transfer member 15C and are removed at cleaner 31C. The predetermined number of cycles in the clean-up mode is sufficient to thus remove the contaminating fuser release oil from photoconductive members 14C, M, Y, and K and thereby eliminate the print quality defects caused therefrom.

As noted above, an alternate embodiment may be provided wherein the marking particles from all four intermediate transfer members 15C, M, Y, and K are transferred to transport belt 26 and then removed from transport belt 26 by cleaning blade 42. As also noted above this alternate embodiment of the method of the present invention would only be advantageous if reservoir 44 were sized to accommodate a relatively large quantity of marking particles so as to not require frequent attention by the operator.

What is claimed is:

1. A method for controlling fuser release oil contamination in an electrostatographic reproduction apparatus having a plurality of imaging modules in tandem relative to a receiver transport belt movable by a transport path, said method comprising the steps of:

a. identifying events wherein, in said imaging modules, a photoconductive member will operatively contact said receiver transport belt;

b. in the first of said tandem imaging modules in the direction of movement of said receiver transport belt, depositing a substantially uniform layer of charged pigmented marking particles onto said photoconductive member in the areas that will operatively contact said receiver transport belt;

c. transferring said layer of charged pigmented marking particles from said photoconductive member directly to said receiver transport belt;

d. utilizing said pigmented marking particles to adhere fuser release oil;

e. in the last of said tandem imaging modules in the direction of movement of said receiver transport belt, transferring said layer of charged pigmented particles from said receiver transport belt to said photoconductive member; and f. removing said layer of charged pigmented marking particles from said photoconductive member, thereby removing said fuser release oil.

2. The method of claim 1, wherein said substantially uniform layer of charged pigmented marking particles comprises at least a complete monolayer of said marking particles.

3. The method of claim 1, wherein steps a–f are executed only during duplex printing runs of said electrostatographic reproduction apparatus.

4. The method of claim 3, wherein steps a–e are executed only during duplex printing runs longer than a predetermined minimum run length.

5. A method for controlling fuser release oil contamination in an electrostatographic reproduction apparatus having a plurality of imaging modules in tandem relative to a receiver transport belt movable by a transport path, each imaging module having an intermediate transfer member, said method comprising the steps of:

a. identifying events wherein, in said imaging modules, said intermediate transfer member will operatively contact said receiver transport belt;

b. in the first of said tandem imaging modules in the direction of movement of said receiver transport belt, depositing a substantially uniform layer of charged pigmented marking particles onto said intermediate transfer member in the areas that will operatively contact said receiver transport belt;

c. transferring said layer of charged pigmented marking particles from said intermediate transfer member directly to said receiver transport belt;

d. utilizing said pigmented marking particles to adhere fuser release oil;

e. in the last of said tandem imaging modules in the direction of movement of said receiver transport belt, transferring said layer of charged pigmented particles from said receiver transport belt to said intermediate transfer member; and f. removing said layer of charged pigmented marking particles from said intermediate transfer member, thereby removing said fuser release oil.

6. The method of claim 5, wherein said substantially uniform layer of charged pigmented marking particles comprises at least a complete monolayer of said marking particles.

7. The method of claim 5, wherein steps a–f are executed only during duplex printing runs of said electrostatographic reproduction apparatus.

8. The method of claim 7, wherein steps a–e are executed only during duplex printing runs longer than a predetermined minimum run length.

9. In an electrostatographic reproduction apparatus having a plurality of imaging modules in tandem relative to a receiver transport belt moveable along a transport path, each said imaging module having a photoconductive member, a method of removing fuser release oil contamination comprising the steps of:

a. in each said imaging module, for a predetermined number of cycles, depositing a substantially uniform layer of charged pigmented marking particles onto said photoconductive member;

b. in all except the last of said imaging modules, in the direction of movement of said receiver transport belt, transferring said layer of charged pigmented marking particles from said photoconductive member directly to said receiver transport belt;

c. utilizing said pigmented marking particles to prevent fuser release oil from contaminating said photoconductive member;

d. in the last of said imaging modules, in the direction of movement of said receiver transport belt, removing said layer of charged pigmented marking particles, deposited in step a, from said photoconductive member;

e. in the last of said imaging modules, in the direction of movement of said receiver transport belt, transferring said layer of charged pigmented particles, transferred to said receiver transport belt in step b, from said receiver transport belt to said photoconductive member; and f. in the last of said imaging modules, in the direction of movement of said receiver transport belt, removing said layer of charged pigmented marking particles, transferred from said receiver transport belt in step e, from said photoconductive member.

10. The method of claim 9, wherein said substantially uniform layer of charged pigmented marking particles comprises at least a complete monolayer of said marking particles.

11. In an electrostatographic reproduction apparatus having a plurality of imaging modules in tandem relative to a receiver transport belt movable by a transport path, each said imaging module having an intermediate transfer member, a method of removing fuser release oil contamination comprising the steps of:

a. in each said imaging module, for a predetermined number of cycles, depositing a substantially uniform layer of charged pigmented marking particles onto said intermediate transfer member;

b. in all except the last of said tandem imaging modules in the direction of movement of said receiver transport belt, transferring said layer of charged pigmented marking particles from said intermediate transfer member directly to said receiver transport belt;

c. in the last of said imaging modules, removing said layer of charged pigmented marking particles, deposited in step a, from said intermediate transfer member;

d. utilizing said pigmented marking particles to adhere fuser release oil;

e. in the last of said tandem imaging modules in the direction of movement of said receiver transport belt, transferring said layer of charged pigmented particles, transferred to said receiver transport belt in step b, from said receiver transport belt to said intermediate transfer member; and f. in the last of said imaging modules, removing said layer of charged pigmented marking particles, transferred from said receiver transport belt in step e, from said intermediate transfer member.

12. The method of claim 11, wherein said substantially uniform layer of charged pigmented marking particles comprises at least a complete monolayer of said marking particles.

* * * * *